United States Patent [19]

Fox

[11] 3,987,504

[45] Oct. 26, 1976

[54] KNEE COMFORT

[75] Inventor: Roslyn Fox, Montreal, Canada

[73] Assignee: Lawrence Peska Associates, Inc., New York, N.Y. ; a part interest

[22] Filed: July 21, 1975

[21] Appl. No.: 597,900

[52] U.S. Cl. ..... 5/111; 5/69

[51] Int. Cl.[2] ..... A47C 19/16

[58] Field of Search ..... 5/68, 69, 111, 317, 5/327 R, 91, 92

[56] References Cited

UNITED STATES PATENTS 893,364 7/1908 Piaser ..... 5/111

1,075,752 10/1913 Bartholme ..... 5/69

*Primary Examiner*—Paul R. Gilliam

*Assistant Examiner*—Andrew M. Calvert

[57] ABSTRACT

An adjustable cot is disclosed having an adjustable knee comfort device which comprises a folding planar surface extending in the same direction as the leg supporting portion of the cot and intermediate the ends of the leg supporting portion whereby the knee comfort device is adjusted from a planar configuration to an upwardly projecting configuration substantially in the area of the leg supporting portion of the cot that provides support for the section of the leg under the knee.

4 Claims, 5 Drawing Figures

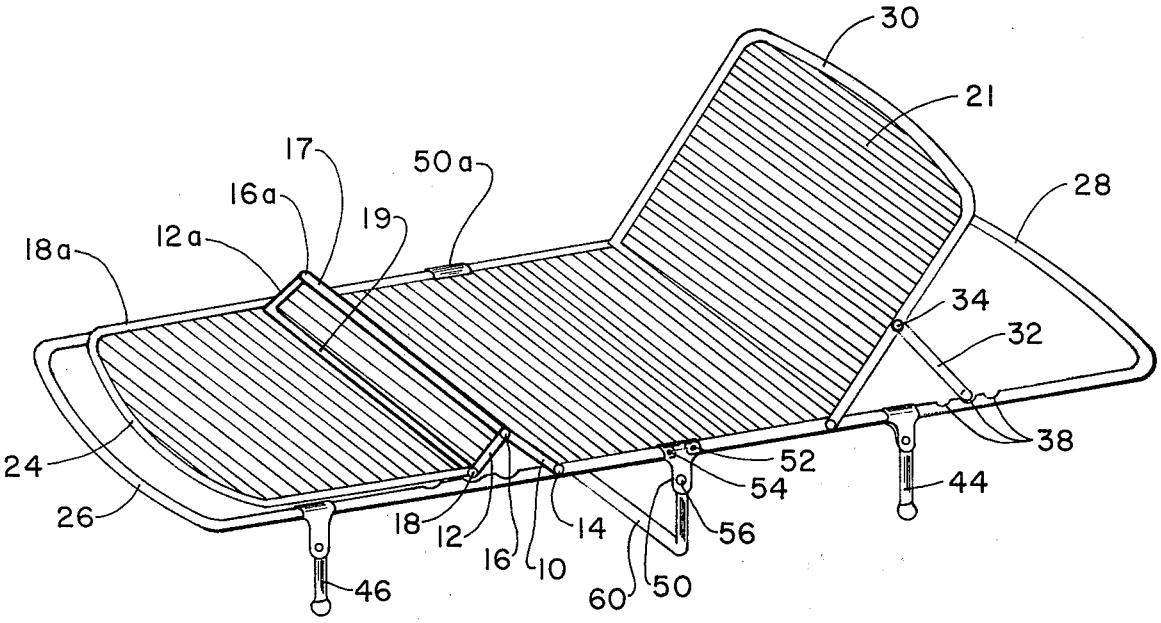
FIG. 1
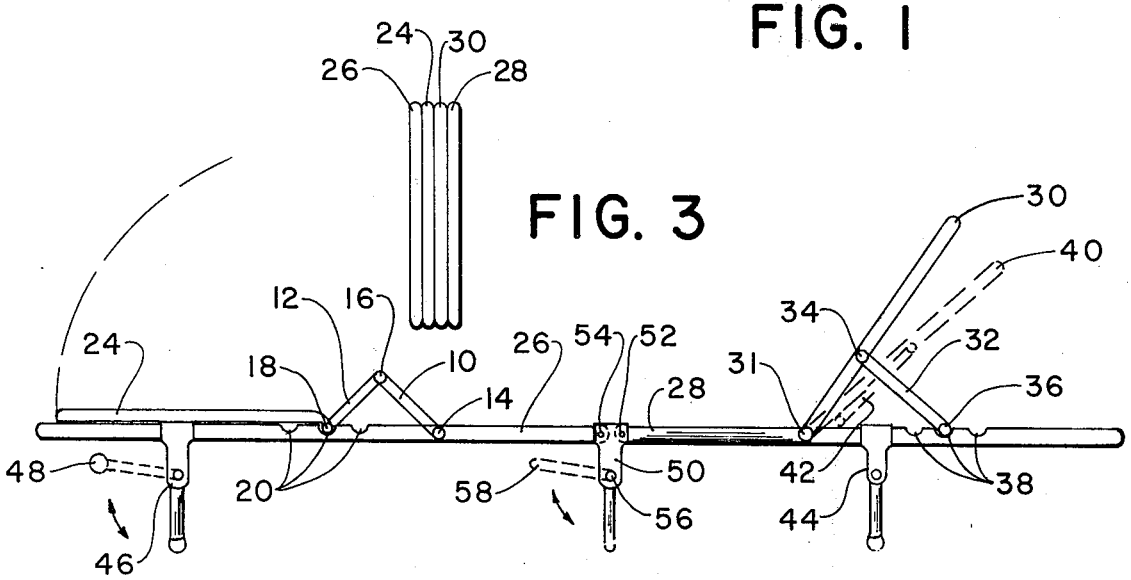
FIG. 3
FIG. 2
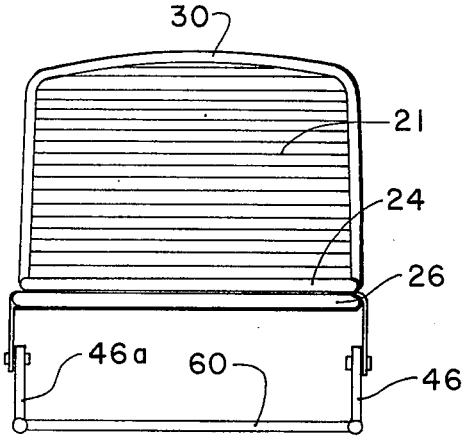
FIG. 4
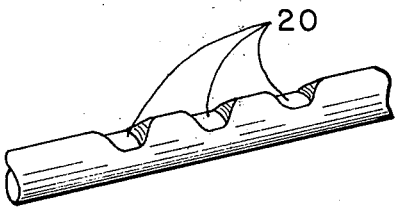
FIG. 5

KNEE COMFORT

SUMMARY OF THE INVENTION

The present invention relates to an adjustable support for receiving a reclining human figure comprising a torso support joined to a leg support, the latter having a knee comfort device which comprises a folding planar surface extending in the same direction as the plane of the leg support and intermediate the ends of the leg support and wherein the knee comfort device is adjustable from a planar configuration to an upwardly projecting configuration substantially in the area of said leg support that provides support for the portion of the leg under the knee.

BRIEF DESCRIPTION OF THE SEVERAL VIEWS OF THE DRAWING

FIG. 1 is a perspective view of one embodiment of the present invention comprising an adjustable cot provided with a knee comfort device.

FIG. 2 is a side elevation of the cot illustrated in FIG. 1.

FIG. 3 is a plan view of the cot illustrated in FIG. 1 folded over on itself and in which all of the adjustable members have been placed in a flat arrangement.

FIG. 4 is a front elevation of the cot illustrated in FIG. 1 wherein the knee comfort device has been retracted into a fully flat configuration.

FIG. 5 is a perspective view in section illustrating the notches employed in the arm of the frame underneath the knee comfort device illustrated in FIG. 1 and are employed in adjusting the height of the knee comfort device.

DETAILED DESCRIPTION

The folding cots of the prior art have been found to be uncomfortable for some users not only because when used with the back rest in an upright position there is a tendency to slide or move toward the foot of the cot but also because the user has to overcome this tendency by bracing her or his foot against the frame at the foot of the cot which exertion on the leg muscles prevents the user from completely relaxing. It is also known in the prior art that relaxation in a prone position can be enhanced if some support can be provided under the knees; however, when using the cots of the prior art with adjustable back-rests that cause the user to slide forward this type of relaxation cannot be achieved since the user is employing her or his leg muscles to keep from moving forward and consequently cannot relax the muscles at the knee joint or provide the type of support that would enhance such relaxation.

It is therefore an object of the present invention to overcome these and other difficulties encountered in the prior art.

It is a further object of the present invention to provide a support, especially an adjustable support for receiving a reclining human figure where such support has a knee rest to provide knee comfort.

These and other objects have been achieved by the present invention which will become readily apparent by reference to the disclosure and claims that follow as well as the appended drawings.

The construction and use of the support for receiving a reclining human figure according to the present invention will be further understood, and especially the knee comfort device, by reference to the attached drawings wherein FIGS. 1, 2 and 4 shows an adjustable support such as a cot which can be adjusted to provide a surface for fully prone reclination, partially prone reclination or sitting erect with the legs extended fully toward the foot. The cot shown in FIGS. 1, 2 and 4 is provided with an adjustable knee comfort section which comprises a folding planar surface constructed from a foldable U-shaped frame 24 with at least two hinged joints 16 and 18 on the section of the arms 10 and 12, extending from and a part of frame 24. The frame 24 is hingedly secured through hinged joint 14 to the leg supporting U-shaped frame 26. Hinged joints 14, 16 and 18 are positioned opposite their counterpart joints on the other side of the frames 24 and 26, only counterpart hinged joints 16*a* and 18*a* being illustrated in the drawing. Rigid semi-rigid or resilient support means 17 and 19 transverse to and connected to the arms of said frame 24 at joints 16, 18, 16*a* and 18*a* are also provided however these support means can be eliminated and support provided solely be means of resilient weight supporting members 21 which span the frame 24 and are secured thereto by securing devices well known in the art such as rivets and the like. In one embodiment, weight support members 21 which also span and are secured to frames 26, 28 and 30 may be plastic webbing or strands or any of the art known equivalents thereof. The knee support comprising frame 24 hinged arms 10 and 12 extending therefrom and weight supporting members 21 in one embodiment comprise the folding planar surface which extends in the same direction as the plane of the leg supporting frame 26 and is hingedly secured to frame 26 at a point intermediate the ends of frame 26. The knee support or knee comfort member of the present invention is also adjustable and is secured to frame 26 in such a manner so that it is adjustable from a planar configuration to an upwardly projectly configuration substantially in the area of the leg supporting frame 26 that provides support for the portion of the leg under the knee. Adjusting means for said knee comfort member are provided and comprise a plurality of notches 20 on the arms of said frame 26 which are adapted to receive joint 18 so that the knee comfort device can be adjusted in one embodiment from a flat position or configuration to an upwardly pointing inverted U-configuration.

The support or cot of the present invention also has a torso supporting member comprising U-shaped frame 28 which is foldably connected to frame 26 at the ends thereof through hinge 50 and pins 52 and 54. Counter part hinge 50*a* is placed opposite hinge 50 to foldably join the other ends of frames 26 and 28. An adjustable back comprising U-shaped frame 30 is hingedly secured to frame 28 through hinge 31 and is adjustable through adjusting arms 32 hingedly secured to frame 30 through hinge, the free end of arm 32 being insertable in notches 38 on the arm of frame 28 so that the adjustable back is adjustable from a position co-planar with frame 28 to an upright angle sufficient to provide back support. Phantom configuration 40 and 42 show the positioning of frame 30 and arm 32 when the adjustable back is made ready for folding into a position co-planar with frame 28.

Folding legs 44 and 46 are also provided so that the cot of the present invention can be folded in a compact position with a minimum of protuberances. Phantom configuration 48 illustrates the position of leg 46 when it is folded. Folding leg 56 is reinforced with a transverse member secured to the ends thereof, leg 56 also being foldable as shown in phantom configuration 58.

FIG. 3 illustrates how the cot of the present invention may be folded so that frames 24 and 30 may be brought together so that the outer side of the folded cot comprises frames 26 and 28.

In operation, knee comfort device comprising frame 24 and arms 12 and 10 as well as counterpart arms corresponding thereto on the other side of the frame 24 is adjusted to provide maximum comfort while reclining on the cot shown in FIGS. 1, 2 and 4. The adjustment is made by positioning joint 18 in the notch 20 that is most suited to the person reclining on the cot. When the back rest comprising frame 30 is adjusted upwards by placing the end 36 of arm 32 into one of the notches 38 on the arms of frame 28, the person reclining on the cot has less of a tendency to slide forward because of the positioning of the knee comfort device which not only provides support for the portion of the leg under the knee but also tends to prevent the user of the cot from sliding forward toward the foot thereof and eliminates or minimizes the necessity of bracing the body against forward movement by placing the heel against the foot of the cot.

Although the invention has been described by reference to some embodiments it is not intended that the novel device described herein be limited thereby, but that certain modifications are intended to be included within the broad scope and spirit of the foregoing disclosure, the following claims and the appended drawings.

What is claimed is:

1. An adjustable support for receiving a reclining human figure comprising torso supporting means having an adjustable back, said torso supporting means comprising first U-shaped frame means with weight supporting means extending across the span of said first U-shaped frame means and secured to said first U-shaped frame means, said torso supporting means connected to leg supporting means comprising second U-shaped frame means having weight supporting means extending across the span of said second U-shaped frame means and being secured to said second U-shaped frame means, said first U-shaped means and said second U-shaped frame means being foldably connected to one another, said second U-shaped frame means having adjustable knee comfort means operatively secured thereto which comprises folding planar surface means extending in the same direction as the plane of said leg supporting means and intermediate the ends of said leg supporting means, said folding planar surface being adjustable from a planar configuration to an upwardly projecting inverted-V configuration substantially in the area of said leg supporting means that provides support for the portion of the leg under the knee, said knee comfort means further comprising foldable U-shaped frame means, weight support means extending across the span of said foldable U-shaped frame means and secured to said foldable U-shaped frame means, said leg supporting means being horizontally planar in the area in front of said knee comfort means.

2. The adjustable support according to claim 1 comprising a folding cot, said knee comfort means comprising a foldable U-shaped frame having two arms and at least two hinged joint means on each arm of said foldable U-shaped frame, said joint means positioned opposite one another and joining said first frame and said second frame, support means transverse to and connected to the arms of said foldable U-shaped frame at each of said hinged joints, adjusting means for said foldable U-shaped frame comprising a plurality of notches on the arms of a support frame positioned beneath said second frame and adapted to receive said joint means closest to the end of said foldable U-shaped frame that is hingedly secured to said second frame, said foldable U-shaped frame being adjustable from a flat configuration to an upwardly pointing inverted-V configuration.

3. The folding cot of claim 2 where said adjustable back comprises third U-shaped frame means hingedly secured at the ends thereof to said first frame, weight support means extending across the span of said third frame and secured to said third frame, adjusting arm means hingedly secured to said third frame, a plurality of notch means on the arm of said first frame adapted to receive said adjusting arm so that said adjustable back is adjustable from a position co-planar with said first frame to an upright angle sufficient to provide back support.

4. The folding cot of claim 3 where said first frame and said support frame having folding leg means hingedly secured thereto, middle folding leg means hingedly secured to hinge means on either side of said first frame and said support frame for foldably connecting said first frame to said support frame, said middle leg means having a transverse rigid member secured to the bottom of and joining said middle leg means.

* * * * *